US005220701A

United States Patent [19]

Creato et al.

[11] Patent Number: 5,220,701

[45] Date of Patent: Jun. 22, 1993

[54] PAINTER'S TOOL

[76] Inventors: Timothy F. Creato, 16 Hillman Dr. P.O. Box 1853; Michael J. Creato, 16 Hillman Dr. P.O. Box 1853; Robert T. Morgan, Jr., Nine South St., all of Edgartown, Mass. 02539

[21] Appl. No.: 859,075

[22] Filed: Mar. 27, 1992

[51] Int. Cl.[5] ..... B44C 7/00

[52] U.S. Cl. ..... 7/105; 7/118; 7/156; 81/3.48; 30/143; 30/152; 30/359

[58] Field of Search ..... 7/105, 118, 151, 156; 81/3.09, 3.48; 30/142, 143, 152, 155, 359, 366

[56] References Cited

U.S. PATENT DOCUMENTS

| | | | |
|---|---|---|---|
| 964,558 | 7/1910 | Rose | 7/118 |
| 2,213,071 | 8/1940 | Keller | 7/105 X |
| 2,617,187 | 11/1952 | Hopta | 7/118 X |
| 3,316,634 | 5/1967 | Buss | 30/143 |
| 4,059,894 | 11/1977 | Yakor | 30/359 X |
| 4,187,607 | 2/1980 | Simuro et al. | 7/118 X |

*Primary Examiner*—James G. Smith
*Attorney, Agent, or Firm*—Robert K. Tendler

[57] ABSTRACT

A universal multi-function tool in the form of a painter's knife is provided in which the tool includes a slender pivoted, elongated element with a sharp tip for puncturing caulking tubes and an integral pusher bar specially adapted for contacting glazing points to serve as a glazing point setter for forcing the toothed portions of the glazing point into corresponding window and door frames. The tool is also provided with a paint can opener and both phillips head and flat head screwdrivers to permit storm window screw removal as well as light fixture plate removal. A knife is also provided for removal of the caulking tube tip, thereby eliminating the necessity of a razor knife, although a detachable razorblade holder is provided as an optional feature for cleaning windows. All of the tool elements are pivoted at respective ends of the tool, with the subject painter's knife providing no sharp objects protruding into the painter or his pocket.

7 Claims, 3 Drawing Sheets

PAINTER'S TOOL

FIELD OF INVENTION

This invention relates to multi-purpose knives and more particularly to a universal tool particularly useful in the painting trade.

BACKGROUND OF THE INVENTION

Painters, perhaps more than any other artisan, ply their trade at great heights above the ground usually on the top of ladders or atop scaffolding which is not necessarily as stable as desired. Additionally, a large amount of a painter's time is spent painting windows and doors, or indeed moldings, all of which require caulking or glazing putty of some type. Typically, the painter utilizes a caulking gun in which a caulking tube is inserted into a frame and the caulk extruded from the tip or nozzle of the tube. Tubes come with an elongated tip or nozzle which must be punctured with an elongated instrument in excess of four inches in length. Prior to puncture, the nozzle must be sliced off to provide the appropriate bead. In usual practice, the painter carries a coat hanger for the puncturing of the tube, a knife for the slicing of the tube, a putty knife for pushing the glazing points, and a variety of different screwdrivers for removal of switch plates, storm window brackets, sashes, and the like. Ordinarily, the painter does not wear a belt outside his painter's pants or overalls. This precludes the possibility of providing all of these tools in a convenient belt-carried holder. Rather the painter's pants are provided with numerous pockets and belt loops.

Aside from the inconvenience of having multiple tools which are required in the painting process, the tools themselves are often sharply pointed and therefore can cause injury should the painter fall on them.

While multiple element tools have been provided in the past, none of the prior art tools are specially adapted for use in the painting trades, and more specifically, none of the tools provide a combination of both apparatus for opening the caulking tube while at the same time providing an integral tool for glazing point setting. Further, no tools in the prior art combine the above elements with other tools in a combined tool set, such as flat head and phillips head screwdrivers, as well as the knives themselves.

There is therefore a need for a single tool in which the tool elements are protected within a housing and which are pivoted in an extendable and a one-hand operation to provide the unique functions required by painters. There is a further need to provide all of the functions of tools required by painters in one convenient instrument in which the elements are protected within the tool housing until pivoted and extended for use.

Of paramount importance is the requirement of a slender, cylindrical tool or poker having a longitudinal extent capable of being inserted into the nozzle of a caulking tube and extending down into the caulking tube to pierce the seal at the top of the tube where the nozzle joins the tube top. The nozzle piercing element desirably has a cutting edge at its distal end so as to permit easy puncture of the caulking tube seal.

Moreover, equally desirable is the need for a specially designed pusher bar to enable the setting of glazing points through the pushing of the point into adjacent wood or other puncturable material. The pusher bar must be of sufficient thickness to engage the setting point, unlike the thickness of traditional putty knives which are too thin to do the job, too flexible, and are too wide in some instances to permit adequate force to be imparted to the relatively small glazing point. Moreover, with putty knives, oftentimes the blade flexes into glass, cracking it. There is also the possibility of injury to one's hand during this operation.

SUMMARY OF THE INVENTION

The above problems with respect to providing a universal painter's tool are solved by the subject invention in which, a universal multi-function tool in the form of a painter's knife is provided in which the tool includes a slender pivoted, elongated element with a sharp tip for puncturing caulking tubes and an integral pusher bar specially adapted for contacting glazing points to serve as a glazing point setter for forcing the toothed portions of the glazing point into corresponding window and door frames. The tool is also provided with a paint can opener and both phillips head and flat head screwdrivers to permit storm window screw removal as well as light fixture plate removal. A knife is also provided for removal of the caulking tube tip, thereby eliminating the necessity of a razor knife, although a detachable razorblade holder is provided as an optional feature for cleaning windows. All of the tool elements are pivoted at respective ends of the tool, with the subject painter's knife providing no sharp objects protruding into the painter or his pocket. Also the tool is easy to grasp in one hand, to provide an alternative to the tools normally carried separately. Thus, all the painter's tools are available in one universal instrument.

BRIEF DESCRIPTION OF THE DRAWINGS

These and other features of the subject invention will be better understood taken in conjunction with the Detailed Description in conjunction with the Drawings of which.

DETAILED DESCRIPTION

Figure 1:
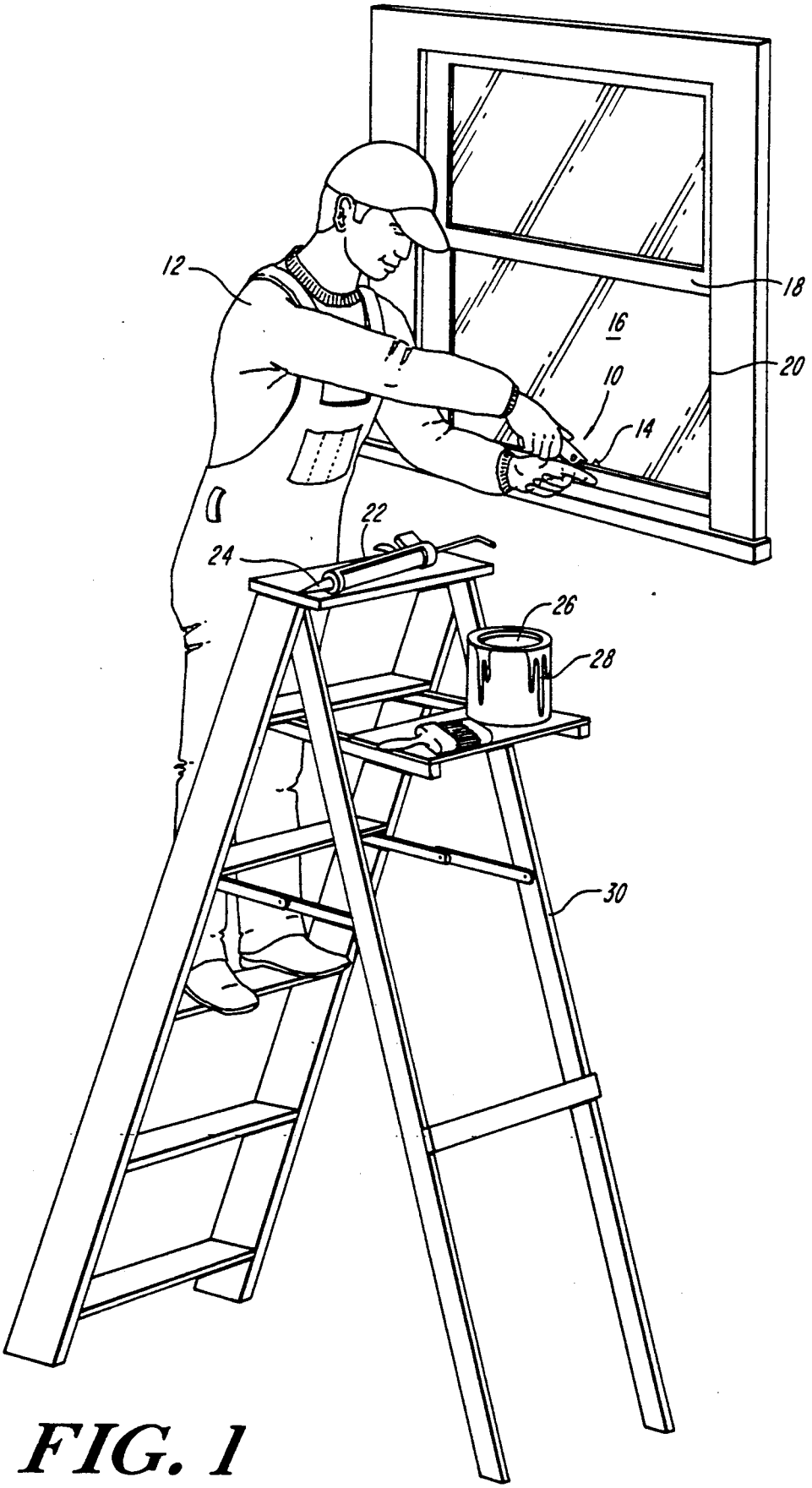
FIG. 1 is a diagrammatic representation of a painter utilizing the subject universal tool for glazing point insertion during the painting process.

Referring now to FIG. 1, a universal tool 10 is used by a painter 12 as illustrated for pushing in glazing points 14 so as to secure a window 16 within a frame 18 prior to applying glazing putty around the periphery 20 of the window. This tool is a universal tool which, as will be seen in connection with FIGS. 2A and B, includes a caulking tube 22 poker that is adapted to be inserted into nozzle 24 of the caulking tube so as to puncture the seal at the throat of the tube. The tool is also provided with a knife for slicing open the top portion of the nozzle of the caulking tube, as well as an integral projection for opening the lid 26 of a paint can 28. Additionally, phillips head and flat screwdrivers are also carried internally in the tool, and the body of the tool is slotted to provide a bottle cap opener.

It will be appreciated that painter 12 spends a good portion of his time on a ladder or scaffolding, here illustrated by reference character 30, such that if he were to have to grope for tools in his painter's pants or otherwise, the inherent instability of ladders might cause him to fall. A universal tool having, in addition to a knife and screwdrivers, a glazing point setter and a caulking tube poker, provides the painter with quick access to all of the usual tools necessary and particularly directed to the painting trades.

Figure 2A:
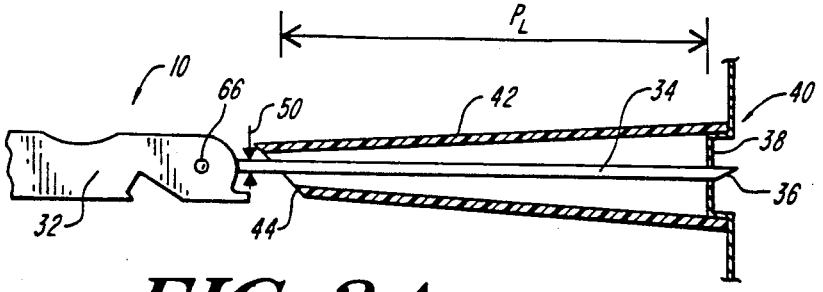
FIG. 2A is a diagrammatic representation of the utilization of the caulking tube poker or puncturing element, illustrating the longitudinal extent of the piercing element vis-a-vis the length of the nozzle or the caulking tube.

Referring to FIG. 2A, tool 10 in one embodiment includes an upwardly opened housing 32 from which is pivoted an elongated element 34 in the nature of a poker for use with caulking tubes, which optionally carries a knife-like or sharpened distal end 36 capable of piercing a gland 38 or diaphram 38 across the top 40 of a typical caulking tube. Each of the caulking tubes is provided with a nozzle 42 which projects a length $P_L$ from the top surface of gland 38 to its mouth 44 into which the poker is inserted. It will be noted that the poker is pivoted at a point 66 so that it is easily flipped out into its operating position as shown in FIG. 2A.

It is essential that the length of the poker be longer than the length of typical nozzles, e.g. in excess of 4 inches. Moreover, the diameter, here indicated by arrows 50, must be no greater than $\frac{1}{8}$ inch, such that the poker must indeed be slender enough to fit into the nozzle aperture at mouth 44 of nozzle 42 without distorting or distending it.

Figure 2B:
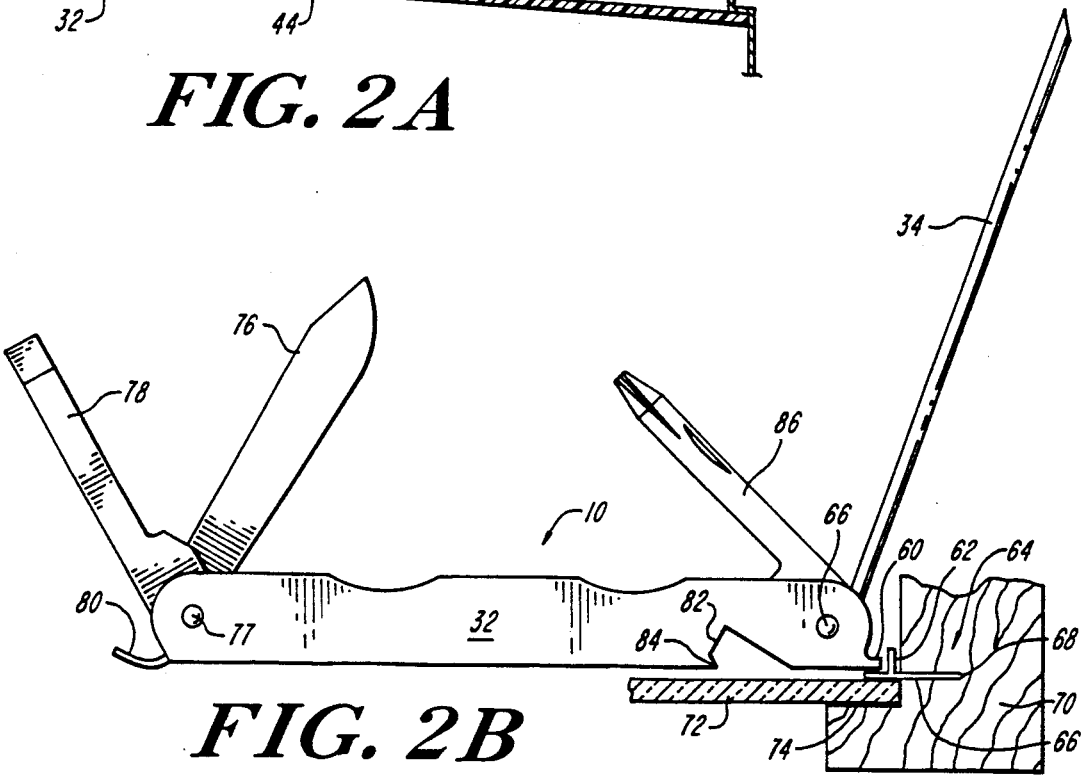
FIG. 2B is a diagrammatic illustration of the subject tool illustrating all of the blades and elements within the painter's tool, as well as indicating the utilization of the glazing point pushing member in relationship to a glazing point.

Referring to FIG. 2B, tool 10 also includes an integral projection which serves as a pusher bar 60 at the right-hand end of the tool. The pusher bar is utilized to push against an upstanding portion 62 of a glazing point generally indicated by reference character 64 to include a horizontal portion 67 and a point 68.

It will be noted that projection 60 is to have a laterally-running edge greater than the width of the upstanding portion 62, and is to be non-flexible, unlike putty knives which oftentimes flex into the glass when utilized to push in the glazing point. As can be seen that the glazing point is pushed into a frame 70 above the glass plate 72 which rests upon a lip 74, with the inserted glazing point maintaining the glass on lip 74 until such time as putty or other caulking material can be applied.

These two features of the subject tool are unique to the painting trade and provide the tool with uniquely convenient features.

As can be seen in FIG. 2B, tool 10 is not only provided with the aforementioned poker 34, it is also provided with a knife blade 76 pivoted at a pivot point 77 at the left-hand end of the tool, with a flat head screwdriver 78 also pivoted from this point. Also integrally formed in this end of the tool is a projection 80 which serves as a paint can opener. Body 32 of tool 10 is also provided with a slot 82 angled upwardly as illustrated with a projection 84 projecting into the slot so as to provide for a bottle cap opening function. Also shown in this diagram is a phillips head screw driver 86 which is pivoted about pivot point 66.

Figure 3:
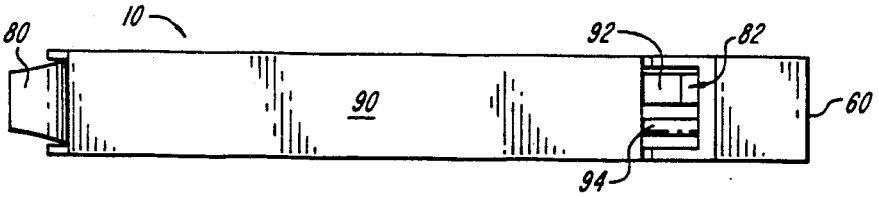
FIG. 3 is a bottom view of the tool of FIG. 2B.

Referring now to FIG. 3, the bottom portion of the tool is shown in which the bottom portion 90 shows integral extensions 80 and 60 at opposite ends thereof for the functions noted above. Here slot 82 is illustrated which exposes portions of the folded down elements of the tool namely a portion 92 of phillips head screwdriver 86 and a portion 94 of poker 34.

Figure 4:
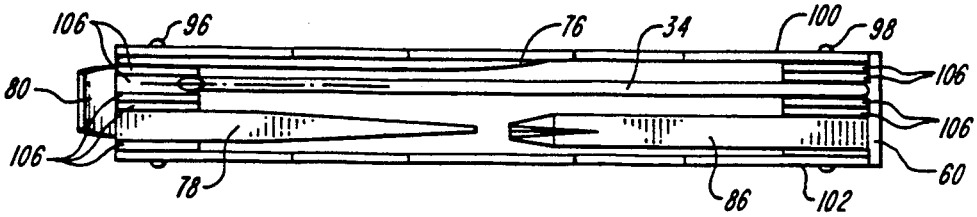
FIG. 4 is a top view of the tool of FIG. 2B.

A top view is illustrated in FIG. 4 which shows the noted elements, in this case held within housing 32 via bolts or other type pinning apparatus 96 and 98, passing through pivot points 77 and 66 respectively. It will be noted that spacers 106 are located inbetween side walls 100 and 102 of tool 10 to separate the various elements of the tool.

Figure 5:
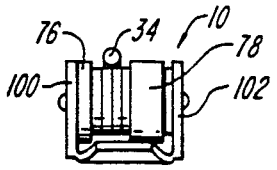
FIG. 5 is an end view of the tool of FIG. 2B taken from the left-hand end.

Referring to FIG. 5, the left-hand end of the tool 10 is shown with the shank of the screwdriver 78 being exposed as well as the shank of the knife 76.

Figure 6:
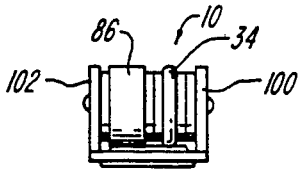
FIG. 6 is an end view, of the tool of FIG. 2B taken from the right-hand end; and, FIGS. 7A and 7B are side and isometric representations showing the optional razor knife embodiment.

Referring to FIG. 6, the right-hand end of tool 10 is shown with the shank of poker 34 and screwdriver 86 located as illustrated.

Figure 7A:
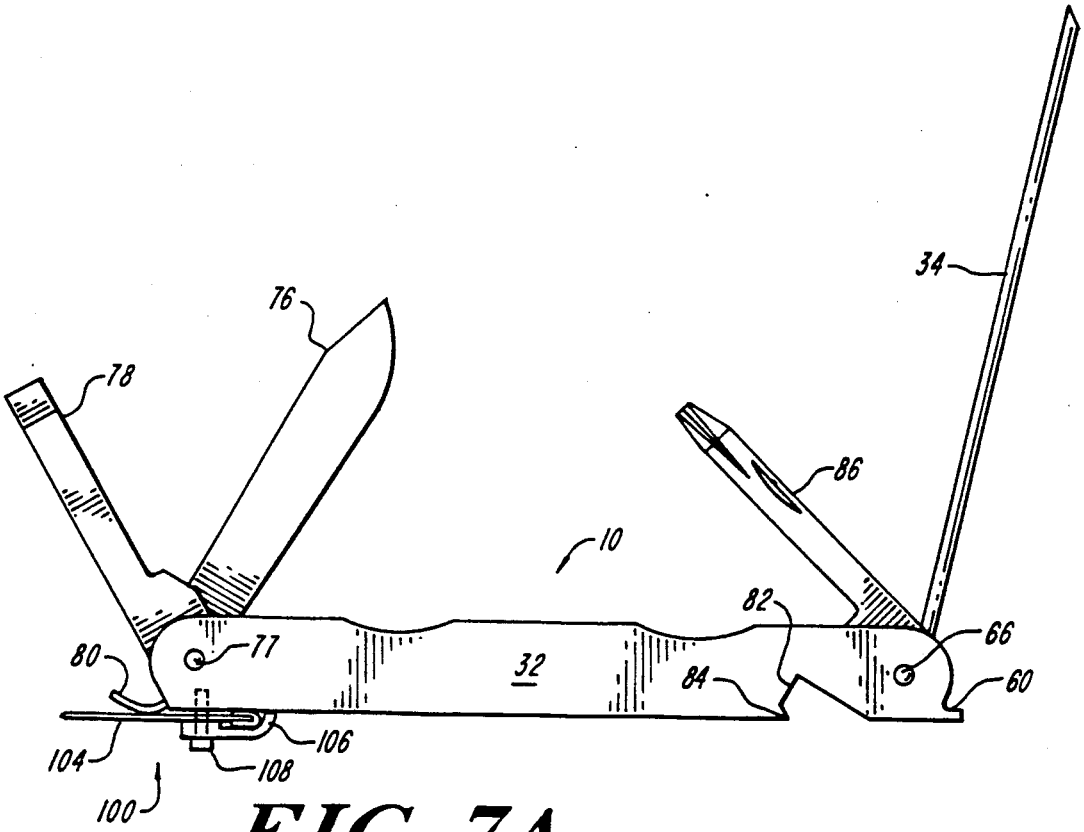

Finally, with respect to FIG. 7A, the subject tool is optionally provided with an integral or detachable razor blade 100 for cleaning windows which includes a conventional safety blade 104 which is disposable and mounted via clamp 106 to body 32 through the use of a knob or neuraled projection 108 as illustrated.

Figure 7B:
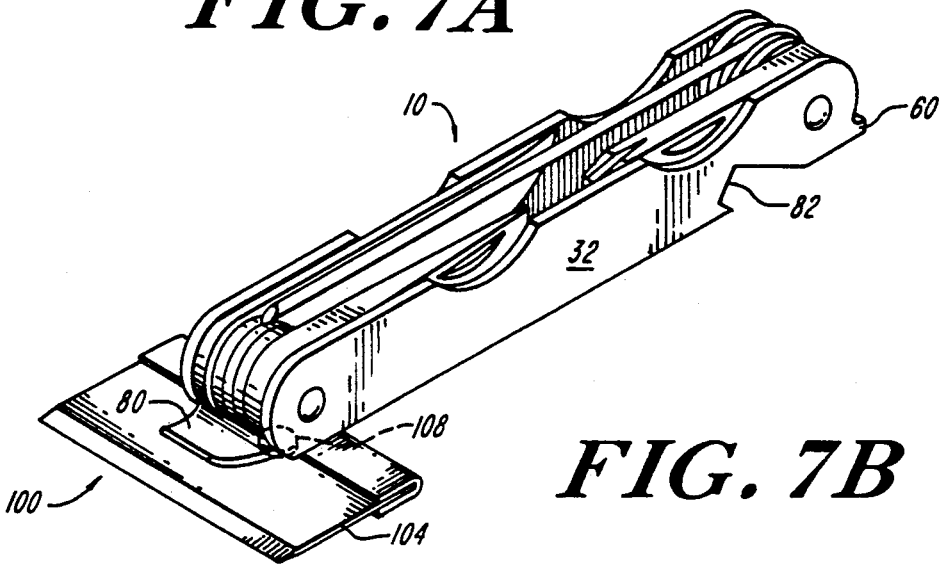

As can be seen from FIG. 7B, the lateral extent of the blade is commensurate with the width of housing 32 so that when retracted, the tool may be slipped into a painter's pocket.

What will be appreciated is that what has been provided is a universal painter's tool capable of at least two new functions not previously provided in multi-element knives or tools. Moreover, because of the particular combination of the tool elements involved, the subject tool is indeed universal and provides the painter with a number of necessary functions to ply his trade.

Having above indicated a preferred embodiment of the present invention, it will occur to those skilled in the art that modifications and alternatives can be practiced within the spirit of the invention. It is accordingly intended to define the scope of the invention only as indicated in the following claims.

We claim:

1. A universal multi-function tool for use in the painting trades comprising:

a u-shaped tool body having a hollow central region open at one surface thereof and closed at a bottom surface opposite said one surface;

at least one pivot pin running laterally across said tool body; and, a plurality of tool elements pivoted to said tool body at an end thereof, each tool element being secured to said tool body at a pivot pin; one of said tool elements including an elongated thin shaft to serve as a poker for caulking tubes each of said caulking tubes having a nozzle and a pierceable member removed from the tip of said nozzle, said shaft having a longitudinal direction greater than the distance from the tip of said caulking tube nozzle to said pierceable member, said u-shaped body including a rigid projection extending from one end thereof at said bottom surface, said projection having an edge which protrudes beyond the associated end of said tool, said edge being of a configuration adapted to contact the upstanding portion of a glazing point, whereby said projection forms a glazing point pusher bar.

2. The tool of claim 1 wherein said shaft has a tip and wherein said tip includes a sharpened portion for piercing said pierceable member.

3. The tool of claim 1 wherein said elements include a screw driver and a knife.

4. The tool of claim 1 wherein said elements include a screw driver and a knife.

5. The tool of claim 1 wherein said u-shaped body has sides and wherein said body has a notch in said bottom surface which extends up the sides of said u-shaped body, said notch configured to accommodate and permit removal of bottle caps, said notch leaving an outwardly projecting bottom surface portion adapted to contact an edge of a bottle cap.

6. A universal multi-function tool for use in the painting trade comprising:

a u-shaped tool body having a hollow central region open at one surface thereof and closed at a bottom surface opposite said one surface;

at least one pivot pin running laterally across said tool body; and, a plurality of tool elements pivoted to said tool body at an end thereof, each tool element being secured to said tool body at a pivot pin; and further including a razor blade having a blade extensible past an end of said tool in a direction parallel to said bottom surface and means for mounting said razor blade to said bottom surface.

7. The tool of claim 6 wherein said razor knife is detachable.

* * * * *